US005704723A

United States Patent [19]

Salisian

[11] Patent Number: 5,704,723

[45] Date of Patent: Jan. 6, 1998

[54] SOAP DISPENSING DEVICE

[76] Inventor: Harold W. Salisian, 2 S. Golden West Ave., Arcadia, Calif. 91007

[21] Appl. No.: 705,286

[22] Filed: Aug. 29, 1996

[51] Int. Cl.[6] ..... B05C 17/00; A47L 13/17

[52] U.S. Cl. ..... 401/8; 401/201

[58] Field of Search ..... 401/8, 201

[56] References Cited

U.S. PATENT DOCUMENTS

| | | | |
|---|---|---|---|
| 1,173,802 | 2/1916 | Hobbs | 401/201 |
| 1,208,623 | 12/1916 | Nakashima | 401/201 X |
| 1,854,415 | 4/1932 | Miller | 401/201 |
| 3,143,755 | 8/1964 | Rowley | 401/201 X |
| 3,426,464 | 2/1969 | Mezey | 401/201 |
| 4,159,883 | 7/1979 | Mizell | 401/201 |
| 4,240,760 | 12/1980 | Levine | 401/201 |
| 4,457,643 | 7/1984 | Caniglia | 401/201 |
| 4,515,703 | 5/1985 | Haq | 252/92 |

FOREIGN PATENT DOCUMENTS

| | | | |
|---|---|---|---|
| 169615 | 12/1951 | Austria | 401/8 |
| 1219672 | 5/1960 | France | 401/201 |
| 452131 | 5/1968 | Switzerland | 401/201 |

*Primary Examiner*—Steven A. Bratlie
*Attorney, Agent, or Firm*—Gene Scott - Patent Law & Venture Group

[57] ABSTRACT

The present invention relates to a dispensing device for releasing a liquid active material such as soap or other active formulation in the form of a concentrate. The dispensing device includes a foam-like outer cover that encloses a pouch which has a membrane allowing the material to transfer to the cover at a selected rate. The rate is determined by the type of material used for the membrane and the size and number of pores in it, allowing the liquid through at a desired rate. The rate is further determined by the amount of external squeeze pressure applied to the device. The pouch is refilled by a sack containing the concentrate. The sack also contains small holes or pores for ejecting the concentrate when pressure is applied. Because the pores in the sack face away from the pores of the pouch, the concentrate has time and space to mix with water to form a diluted mixture desired for washing.

10 Claims, 4 Drawing Sheets

SOAP DISPENSING DEVICE

FIELD OF THE INVENTION

This invention relates generally to dispensing devices used for washing the body in the shower or bath or alternately for washing a Vehicle or other object providing a surface to be cleaned. More particularly, this invention relates to a foam or sponge scrubbing device containing a liquid cleanser for even distribution at a selected rate and which can be refilled for repeated usage.

BACKGROUND OF THE INVENTION

In a typical bathtub or shower facility a soap dish or soap alcove is provided. The soap dish collects water in it, tending to cause deterioration of a soap bar that is left sitting in such water. This reduces the usefulness of the soap bar through "melting", and creates a messy situation requiring frequent cleaning. Wash cloths and sponges are used with soap bars for general body and face washing. This very traditional approach is unsatisfactory for several reasons. First of all, two hands are required to accomplish the transfer of soap to the wash cloth, etc. This is difficult for those with ailments and impossible for those unable to use one hand. Second, the use of such techniques does not result in an economical use of soap bars in general since most of the soap is not directed at the body but is flushed down the drain. Thirdly, the wash cloth, etc. requires rinsing after such use, an unnecessary procedure. Additionally, it is well known that a wet soap bar underfoot is frequently cause of falls resulting in injury or worse. As a bar of soap becomes small it becomes more difficult to grasp and tends to squirt out of hand. As the bar becomes quite small, it is usually discarded for lack of utility thereby wasting a significant amount of the soap.

To overcome these problems, several types of sponge containers with a hollow, soap-housing center opening have been created. In these devices, the sponge material is porous and thereby permits water to pass through the cover and wet the enclosed soap. Lather thus formed may exit through the porous material to the skin's surface. These devices significantly improve over the two-handed cloth and soap operation, but they still have problems. One problem with such devices is that while water is allowed into the soap area to provide lather, it is also easily trapped there after use is completed. Thus, this stagnant water works to more quickly deteriorate the soap as well as provide a breeding ground for mildew. This configuration also makes it difficult to clean out this area before replacing the soap.

One of the biggest problems of the prior art dispensing devices is that they are unable to easily retain a supply of soap in the hollow interior of the envelope-like sponge container. One approach to retain the soap in the container has been to use rigid fasteners to close the entranceway at one end of the container, but such rigid fasteners may scratch or otherwise injure a person using the container, and, if metal, such fasteners may tend to rust or corrode. Another approach to securing soap inside such a sponge container has been to provide a narrow entrance to the container interior with such entrance being resiliently expandable under force to allow the soap entry. A disadvantage with the later approach is that the soap bar may easily be ejected from such an opening, especially as the soap becomes smaller with use.

The present new invention improves upon these prior art devices by providing a design that allows the soap to be sealed within the outer covering and yet still able to be replaced when needed. It avoids the problem of mildew and water stagnation by employing a liquid cleanser that is housed in a pouch made of latex or the like.

Numerous innovations for dispensing devices have been provided in the prior art that are described as follows. Even though these innovations may be suitable for the specific individual purposes to which they address, they differ from the present invention as hereinafter contrasted.

U.S. Pat. No. 4,515,703 to Zia Haq for Article Carrying Active Material comprises an article for wiping surfaces or releasing an active material. It has a "closed sandwich" structure comprising two substrate layers bonded together in such a way as to create a plurality of compartments, at least some of the compartments containing active material, for example, a soap or detergent or bubble bath composition, at least some of the compartments being provided with one or more perforations in one or both walls for release of the active material. Different compartments have different numbers of perforations in order to allow the active material to be released in a controlled manner over a relatively long period of time. The substrates advantageously comprise paper or non-woven fabric laminated with thermoplastic film, the two substrate layers being bonded together in a grid pattern by heat-sealing of the thermoplastic films.

This prior art patent is an article for wiping surfaces comprising two substrate layers bonded together with the active material embedded within the substrates. In contrast, the present invention has the active material within the device separated by a single separate membrane.

Joseph E. Caniglia's U.S. Pat. No. 4,457,643 for a Sponge for Containing Soap is a device for washing, particularly for cleansing the body while in a shower or bath. It includes a container which forms an envelope for a bar of soap, discrete openings through to the container interior allowing water access to the soap and the facile exiting of lather for washing purposes. It also includes a tab-like locking strip integral with the container material for locking the soap in the container. Preferably there is a plurality of openings and preferably the tab lock is a T-shape or a truncated arrow-shape and is lockable into an opening in the container to block the entrance thereof.

The above referenced prior art is designed specifically for bar soap where there is maximum access for the water to reach the soap. On the other hand, the present invention is designed for liquid soap separated by a membrane and therefore not allowing the water direct access to the soap.

U.S. Pat. No. 4,240,760 to Stella R. Levine for a Foam Scrubbing Device Incorporating a Cleanser is formed from two layers of foam material heat sealed along their respective peripheries. The two layers of foam material have different cell coarseness to provide varying degrees of abrasion, permeability and flexibility. The device is formed with the different layers of foam material having different thicknesses to permit substantially equal amounts of cleanser to pass through each layer.

In the above prior art invention, as with the invention mentioned priori there is no mention of the soap or cleansing material being held within a pouch to control the release of the soap at a desired rate as done in the present invention.

U.S. Pat. No. 4,159,883 for a Cleaning Pad to Louis R. Mizell provides an internal well for a cleaning agent. The pad consists of at least one surface formed from a tufted textile fabric with the inner ends of the yarns forming the tufts in communication with the cleaning agent in the well, through yam-containing openings in a plastic film separating the tufted fabric and the well.

The above referenced prior art patent, as with the other patents referenced above, does not deal with having the cleaning agent enclosed within a membrane. This one in particular does not fully enclose the cleaning agent with the foam cover as in the present invention and other prior art patents.

Thus it is that the new invention provides a cleansing device with a liquid cleanser housed within a sponge-type cleaning implement. It is therefore an object of present invention to provide a means of cleansing an object such as a body or vehicle which is both convenient and easy to use.

SUMMARY OF THE INVENTION

In accordance with the invention, an improved dispensing and foam scrubbing device incorporating a cleanser, e.g. soap, shampoo, car wash, is provided. The invention has an outer covering made of sponge, foam rubber, cloth, etc. It is typically constructed in two parts and after a refill soap container or sack is placed within, it is temporarily sealed into an integral or unitized package.

The cleanser is a liquid and is held within a plastic pouch. The pouch can be constructed of a latex rubber with microscopic sized pores designed to allow the cleanser to transfer through the membrane at a selected rate in order to provide a desired result for a selected amount of external squeeze pressure. The number and size of the pores determines how much liquid is dispensed into the outer covering and thus eventually to the surface of the outer covering for transfer to the item being cleaned, coated or polished.

When the supply of pouch liquid or gel is depleted, the device is designed to allow for convenient replenishment. The device can also be tailored in terms of outer covering size and shape. The covering can be made in rectangular, round, oval or any other shape that suits the particular use of the specific device. Accordingly, it is an object of the present invention to provide a simple and effective method of dispensing a liquid through a foam or scrubbing medium. More particularly, it is an object of the present invention to provide a simple means to use a dispensing device for a liquid.

A further object of the present invention is to improve the convenience of using and storing soap. Such a dispenser would be ideal for travel. Still another object of the present invention is to increase the longevity of the soap by using only what is needed. Still another object is to improve the safety in a bathtub, shower, or like environment.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawing.

DETAILED DESCRIPTION OF THE PREFERRED EMBODIMENT

Figure 2:
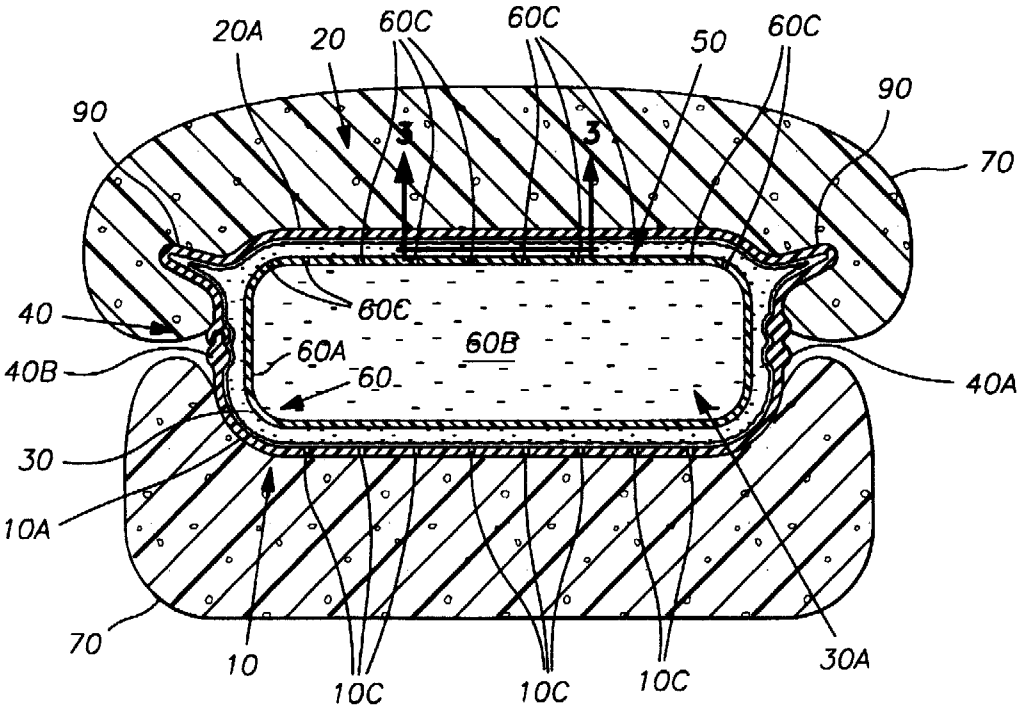
FIG. 2 is a cross-sectional view thereof taken along cutting plane line 22 of FIG. 1, but showing a second embodiment wherein a sponge is substituted for the hand strap of FIG. 1.

As described in the above figures, the present invention is a dispensing device. The device includes a pouch 5 providing a first 10 and a second 20 pouch portions as best seen in FIG. 2. The pouch portions 10, 20 provide a first 10A and a second 20A pouch walls respectively. Each of the walls 10A, 20A have a peripheral edge 10B, 20B. The first pouch portion 10 provides a first means for liquid dispersion 10C preferably a plurality of holes in wall 10A. A liquid mixture 30 is dispersed through the first of the pouch walls 10A through these holes. A closure means 40 joins the peripheral edges 10B, 20B for removably closing the pouch 5, thereby defining a nominal pouch volume 50 therein. This closure means 40 is preferably similar to a zip-lock® type storage bag seal. The volume 50 is enclosed between the pouch portions 10, 20. The pouch walls are of such flexibility and resiliency as to be easily compressed, see FIG. 4, for reducing the pouch volume 50, and for thereafter resiliently resuming the nominal pouch volume.

A liquid storage sack 60 is held within the pouch 5. The sack provides a flexible sack wall 60A enclosing a sack volume 60B approximating the pouch volume 50, but slightly smaller. The sack wall 60A provides a second means for liquid dispersion 60C for dispersing the a liquid formulation 30A through the sack wall 60A toward, or in the direction of, the second pouch portion 20. The first pouch wall 10A provides, in an outwardly facing direction, a means for absorbing 70 extending adjacent to the closure means 40 but not limiting access to it. The second pouch wall 20A provides a means for grasping 80 the dispensing device.

The closure means 40 enables the pouch portions 10, 20 to be separated for replacing the storage sack 60. The closure means 40 preferably includes a hinge means portion 40A and a locking means portion 40B, whereby the locking means portion 40B provides a seal that is liquid impermeable. The hinge portion 40A allows the pouch portions 20, 30 to be opened like a clam shell for access to the interior volume 50. Preferably, the hinge means portion 40A and the locking means portion 40B are formed with an enlarged wall thickness for improved strength and wear resistance as shown in FIG. 2.

Preferably at least one of the pouch portions 10 or 20 or both, includes at least one annular fold 90. The fold 90 is of such size and shape as to provide an accordion action as the at least one pouch portion is compressed and decompressed.

Preferably, also, the pouch portions 10, 20 include an inner surface 100 or lining that provides a rough texture so that with the inner surface 100 in contact with the storage sack 60, the rough texture provides a path for the liquid mixture 30 to move therebetween.

Figure 1:
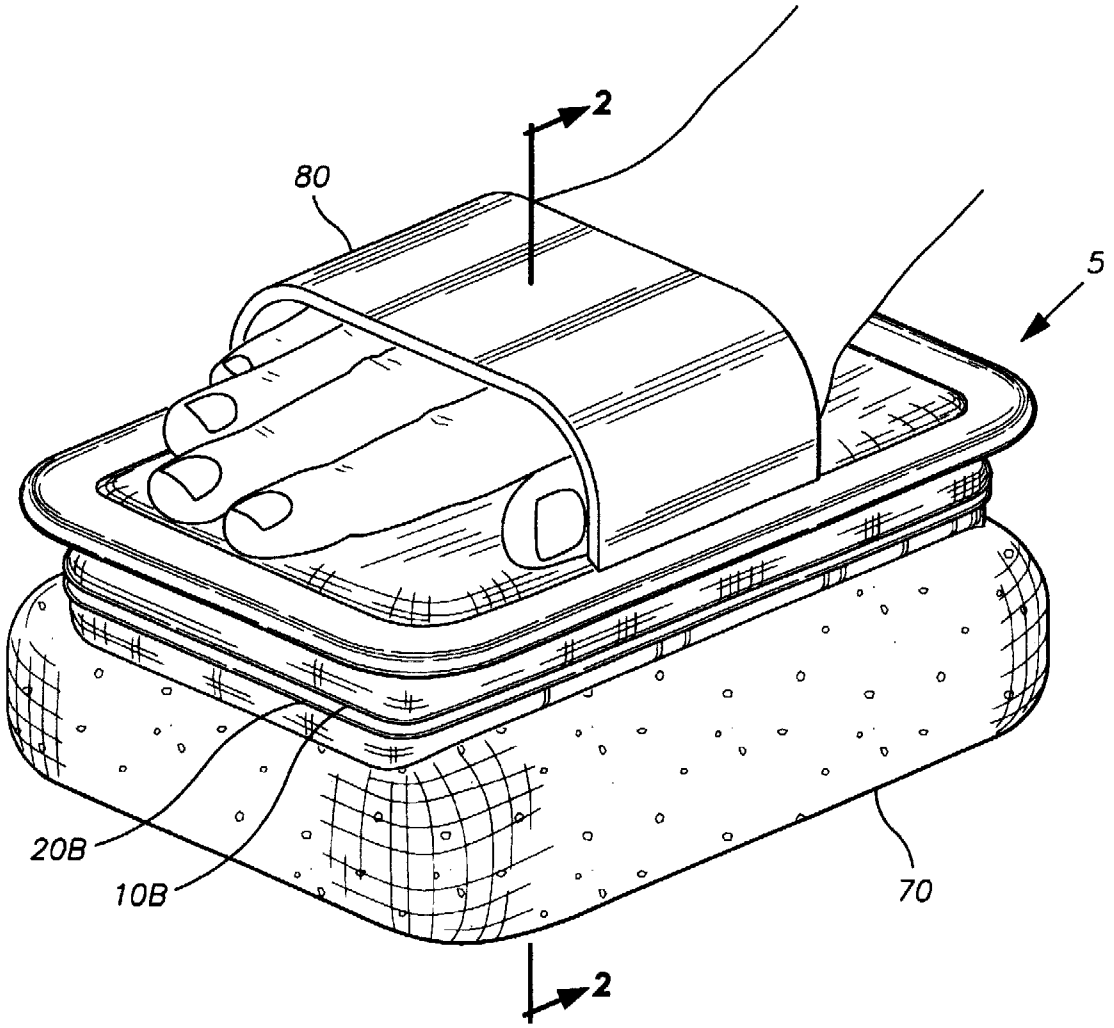
FIG. 1 is a perspective view of the present invention showing a hand strap embodiment.
Figure 3:
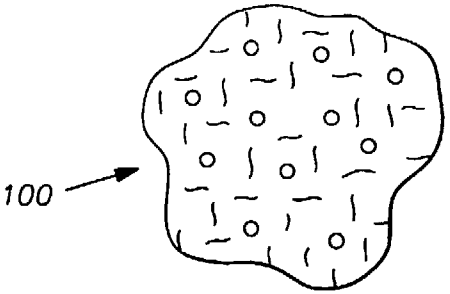
FIG. 3 is a plan view of an interior surface of a wall thereof taken from view line 3—3 in FIG. 2 and showing a rough, non-planar surface texture.
Figure 4:
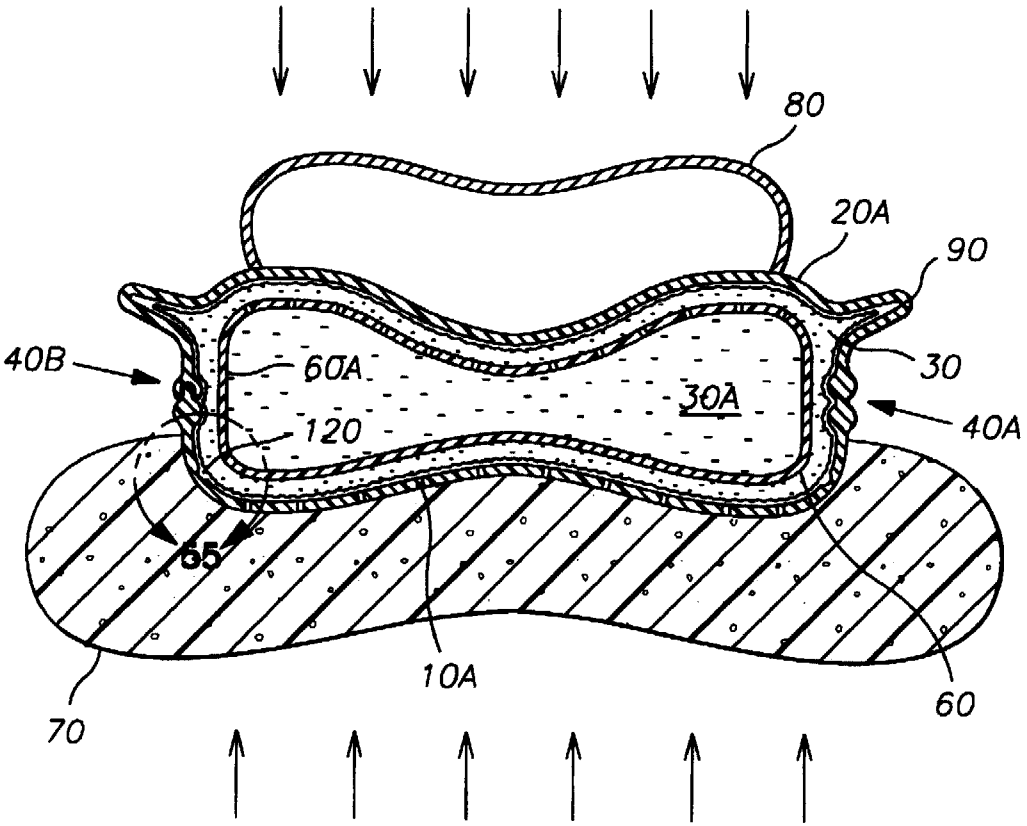
FIG. 4 is a cross-sectional view thereof taken along cutting plane line 2—2 of FIG. 1, showing the compression of the invention possible by pressing downwardly thereupon.
Figure 6:
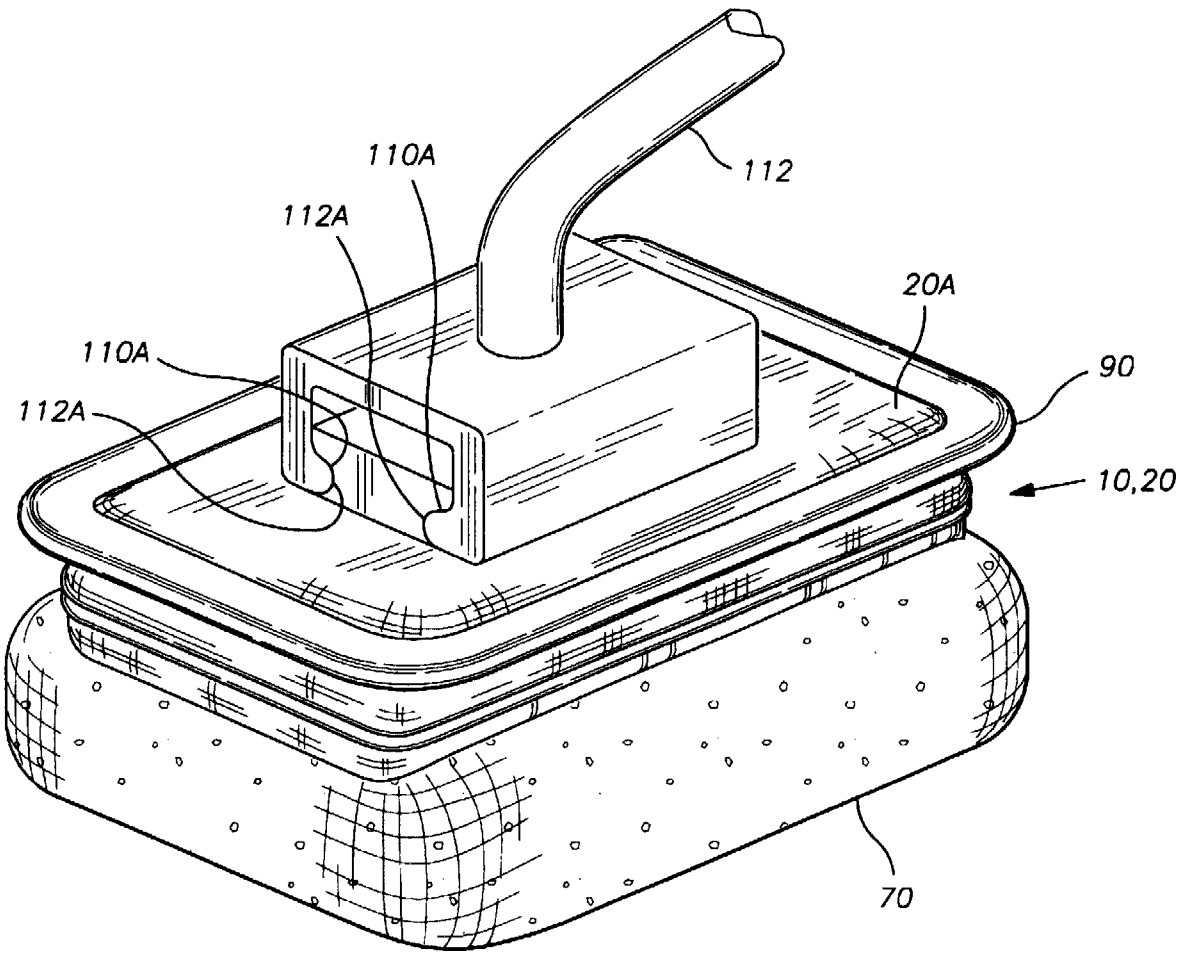
FIG. 6 is a perspective view of the present invention showing an alternate handle attachment method.

Preferably the means for grasping 80 is a hand strap as shown in FIGS. 1 and 4. Alternatively, the grasping means 80 may be an elongate handle as shown in FIG. 6. Such a handle preferably provides a first handle portion 110 fixed to the second pouch wall 20A, and a removable second handle portion 112 adapted for clamping attachment to the first handle portion 110. In this embodiment, the first handle portion 110 provides a pair of opposing concave surfaces 110A, and the second handle portion 112 provides a pair of corresponding convex, surfaces 112A in spring-temper, spaced apart alignment. The second handle portion 112 is preferably engagable with the first handle portion 110 and maintained in such engagement by spring action.

Figure 5:
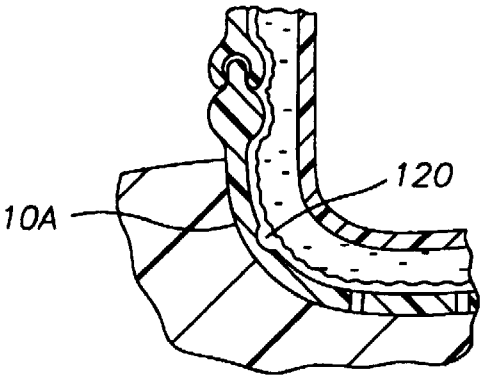
FIG. 5 is a partial elevation side view of a wall of the invention showing the use of a annular depression for reducing the rigidity of the device for improved compression deflection of the wall.

Alternatively, the means for grasping 80 is a sponge-like material generally covering the second pouch wall as shown in FIG. 2. As shown in FIGS. 4 and 5, the pouch walls 10A, 20A, for improved flexibility, include at least one annular depression 120 providing added flexibility for compressing the walls.

In use the present invention is preferably used for washing. The storage sack 60 is filled with a liquid soap formulation 30A, preferably as a concentrate. The sack 60 is then placed into the pouch 5 and the pouch closed and sealed. When the device is immersed, water enters the pouch 5 through the first dispersion means filling the pouch. When the device is compressed, as shown in FIG. 4, the liquid soap formulation 30A is forced out of the sack 60 through the second dispersing means. Because, it is ejected into the pouch volume 50, but away from the first dispersing means it is mixed with the water in the pouch 5 and has enough time to be diluted to an extent before it reaches the first dispersing means. Eventually, the mixture is able to be ejected from the first dispersing means, in a dilute form desirable for washing. The diluted form of the mixture 30 is ejected through the first dispersing means into the means for absorbing 70 from which it is applied to the skin or other surface. Each time the device is compressed, a little of the formulation 30A is mixed with water to add to the supply of mixture 30, and a little of the mixture 30 is forced into the absorbing means 70, and so on until the supply of formulation 30A is depleted. A new storage sack 60 is then used to replace the depleted sack 60.

While the invention has been illustrated and described as embodied in a dispensing device, it is not intended to be limited only to the details shown, since it will be understood that various omissions, modifications, substitutions and changes in the forms and details of the device illustrated and in its operation can be made by those skilled in the art without departing in any way from the spirit of the present invention.

What is claimed as new and desired to be protected by Letters Patent is set forth in the appended claims following.

What is claimed is:

1. A dispensing device for a liquid mixture, the device comprising:

a pouch providing a first and a second pouch portions, the portions providing a first and a second pouch walls respectively, each of the walls having a peripheral edge, the first pouch portion providing a first means for liquid communication through the first wall of the first pouch portion, the liquid mixture being dispersed from the pouch through the first means for liquid communication through the first wall of the first pouch portion, water being drawn into the pouch through the first means for liquid communication through the first wall of the first pouch portion;

a closure means for sealingly joining the peripheral edges for removably closing the pouch, thereby defining a nominal pouch volume therein, the volume being enclosed between the pouch portions, the pouch walls being of such flexibility and resiliency as to be easily compressed for reducing the pouch volume, and for thereafter resiliently resuming the nominal pouch volume;

a liquid soap storage sack within the pouch, the sack providing a flexible sack wall enclosing a sack volume slightly smaller than the pouch volume so as to form a space therebetween for mixing the liquid soap and the water, the sack wall providing a second means for liquid communication for dispersing the liquid soap, the second communication means positioned for directing the liquid soap through the sack wall toward the second pouch portion for enabling the liquid soap and water to mix;

the first pouch wall providing, in an outwardly facing direction, a means for absorbing, the absorbing means extending adjacent to the closure means;

the second pouch wall providing a means for grasping the dispensing device;

the closure means enabling the pouch portions to be separated for replacing the storage sack.

2. The device of claim 1 wherein the closure means includes a hinge means portion and a locking means portion, whereby the locking means portion provides a liquid impermeable seal.

3. The device of claim 1 wherein at least one of the pouch portions includes at least one annular fold, the fold being of such size and shape as to provide an accordion action as the at least one pouch portion is compressed and decompressed.

4. The device of claim 1 wherein the pouch portions include an inner surface, the inner surface providing a rough texture, whereby with the inner surface in contact with the storage sack, the rough texture provides a path for the liquid to move therebetween.

5. The device of claim 2 wherein the hinge means portion and the locking means portion are formed with an enlarged wall thickness for improved strength and wear resistance.

6. The device of claim 1 wherein the means for grasping is a hand strap.

7. The device of claim 1 wherein the means for grasping is an elongate handle, the handle providing a first handle portion fixed to the second pouch wall, and a removable second handle portion adapted for clamping attachment to the first handle portion.

8. The device of claim 7 wherein the first handle portion provides a pair of opposing concave surfaces, and the second handle portion provides a pair of corresponding, convex, surfaces in spring-temper, spaced apart alignment, the second handle portion being engagable with the first handle portion and maintained thereon by spring action.

9. The device of claim 1 wherein the means for grasping is a sponge-like material generally covering the second pouch wall.

10. The device of claim 1 wherein at least one of the pouch walls include an annular depression providing added flexibility for compressing said walls.

* * * * *